US008648735B2

(12) United States Patent
Haynes et al.

(10) Patent No.: US 8,648,735 B2
(45) Date of Patent: Feb. 11, 2014

(54) SAFETY DIRECTIONAL INDICATOR

(76) Inventors: Paul Haynes, Christiansburg, VA (US); Eric Collins, Blacksburg, VA (US)

( * ) Notice: Subject to any disclaimer, the term of this patent is extended or adjusted under 35 U.S.C. 154(b) by 0 days.

(21) Appl. No.: 13/441,561

(22) Filed: Apr. 6, 2012

(65) Prior Publication Data

US 2013/0265176 A1 Oct. 10, 2013

(51) Int. Cl.
*G08G 1/095* (2006.01)
*F21V 21/08* (2006.01)

(52) U.S. Cl.
USPC ..... 340/944; 340/815.42; 340/815.43; 119/859; 362/103; 362/108; 362/249.02; 362/800; 174/135; 24/614; 24/615; 24/170; 24/191; 24/193; 439/467

(58) Field of Classification Search
USPC ..... 340/944, 331, 815.42; 174/135; 24/614–615, 170, 191, 193; 439/467; 362/103, 108, 249.02, 800; 119/859
See application file for complete search history.

(56) References Cited

U.S. PATENT DOCUMENTS 3,641,332 A * 2/1972 Reick et al. ..... 362/582
3,835,445 A * 9/1974 Hardesty ..... 439/410
3,840,853 A 10/1974 Cukale
3,944,803 A * 3/1976 Chao ..... 362/108
4,112,482 A 9/1978 Powell
4,138,185 A * 2/1979 Jaconette, Jr. ..... 439/467
4,169,648 A * 10/1979 Moist, Jr. ..... 439/467
4,328,533 A 5/1982 Paredes
4,523,258 A * 6/1985 Morse et al. ..... 362/108
4,601,538 A 7/1986 Valkenburg
4,652,981 A * 3/1987 Glynn ..... 362/103
4,662,695 A * 5/1987 Gordon et al. ..... 439/92
4,674,155 A * 6/1987 Turtle et al. ..... 24/170
4,755,144 A * 7/1988 Gordon et al. ..... 439/37
4,845,585 A * 7/1989 Weiss ..... 361/220
4,849,863 A 7/1989 Gallegos
4,998,178 A * 3/1991 Weiss ..... 361/220
5,032,960 A * 7/1991 Katoh ..... 362/240
5,036,423 A * 7/1991 Williams ..... 361/212
5,045,979 A 9/1991 Stevens (Continued)

FOREIGN PATENT DOCUMENTS

EP 26600 4/1981
EP 0124786 A 11/1984

(Continued)

*Primary Examiner* — Daniel Wu
*Assistant Examiner* — Kam Ma
(74) *Attorney, Agent, or Firm* — New River Valley IP Law, PC; Michele L. Mayberry

(57) ABSTRACT

Provided is a safety directional indicator to improve highway safety. Embodiments of the invention include devices for guiding a driver of a vehicle in a desired direction, typically away from highway workers, pedestrians, curbs, and opposing lanes of traffic. Specifically included is a safety directional indicator system comprising a flexible belt with a plurality of light transmitting bars disposed along the belt and having a plurality of LEDs disposed at one elongated end of each light transmitting bar and in operable communication with a control system for illuminating the LEDs in a manner to indicate a direction for traffic. Safety devices according to the invention can be stand-alone devices, devices capable of being attached to objects or structures at a highway scene, or configured to be worn on a person's body. An object of the safety devices according to embodiments of the invention is to increase driver awareness of highway situations especially during conditions of restricted visibility.

17 Claims, 4 Drawing Sheets

(56) References Cited

U.S. PATENT DOCUMENTS

| | | | | |
|---|---|---|---|---|
| 5,134,538 | A * | 7/1992 | Weiss | 361/220 |
| 5,151,678 | A | 9/1992 | Veltri et al. | |
| 5,184,274 | A * | 2/1993 | Weiss | 361/220 |
| 5,245,516 | A | 9/1993 | De Haas et al. | |
| 5,249,106 | A | 9/1993 | Barnes et al. | |
| 5,255,168 | A | 10/1993 | Stevens | |
| 5,359,501 | A | 10/1994 | Stevens | |
| 5,381,318 | A | 1/1995 | Fang | |
| 5,434,759 | A * | 7/1995 | Endo et al. | 362/108 |
| 5,444,182 | A * | 8/1995 | Hoshino | 439/368 |
| 5,535,106 | A * | 7/1996 | Tangen | 362/108 |
| 5,667,294 | A * | 9/1997 | Lo | 362/249.05 |
| 5,686,897 | A * | 11/1997 | Loh | 340/649 |
| 5,746,500 | A * | 5/1998 | Chien | 362/103 |
| 5,754,389 | A * | 5/1998 | Hsu | 361/220 |
| 5,779,348 | A | 7/1998 | Interlicchio | |
| 5,836,673 | A * | 11/1998 | Lo | 362/184 |
| 5,879,076 | A * | 3/1999 | Cross | 362/555 |
| D411,894 | S * | 7/1999 | Rick | D26/39 |
| 5,950,571 | A * | 9/1999 | Schade | 119/859 |
| 5,967,095 | A * | 10/1999 | Greves | 119/795 |
| 6,025,773 | A * | 2/2000 | Bresnan | 340/407.1 |
| 6,059,414 | A | 5/2000 | Tsai | |
| 6,146,006 | A * | 11/2000 | Cross | 362/555 |
| 6,183,086 | B1 * | 2/2001 | Neubert | 351/221 |
| 6,288,498 | B1 * | 9/2001 | Cheng | 315/185 S |
| 6,426,859 | B1 * | 7/2002 | Cohen | 361/220 |
| 6,452,774 | B1 * | 9/2002 | Hsu | 361/220 |
| 6,472,994 | B1 * | 10/2002 | Tator | 340/815.4 |
| 6,481,868 | B1 * | 11/2002 | Lin | 362/247 |
| 6,634,779 | B2 | 10/2003 | Reed | |
| 6,756,911 | B2 * | 6/2004 | Striano et al. | 340/815.4 |
| 6,834,395 | B2 | 12/2004 | Fuentes | |
| 6,955,558 | B1 * | 10/2005 | Low et al. | 439/467 |
| 7,008,097 | B1 * | 3/2006 | Hulse | 362/546 |
| 7,013,535 | B2 * | 3/2006 | Tracy | 24/265 R |
| 7,140,327 | B2 * | 11/2006 | Morehead | 119/859 |
| 7,218,238 | B2 * | 5/2007 | Right et al. | 340/628 |
| 7,255,454 | B2 * | 8/2007 | Peterson | 362/147 |
| 7,318,393 | B2 * | 1/2008 | Ayscue | 119/859 |
| 7,735,152 | B2 | 6/2010 | Golle | |
| 7,758,204 | B2 * | 7/2010 | Klipstein et al. | 362/202 |
| 7,800,511 | B1 * | 9/2010 | Hutchison et al. | 340/691.1 |
| 8,152,330 | B2 * | 4/2012 | Waters | 362/200 |
| 8,388,164 | B2 * | 3/2013 | Waters | 362/106 |
| 8,511,856 | B2 * | 8/2013 | Brauser et al. | 362/249.04 |
| 2002/0126503 | A1 * | 9/2002 | Reed | 362/555 |
| 2003/0022549 | A1 * | 1/2003 | Castaldo et al. | 439/467 |
| 2003/0038728 | A1 * | 2/2003 | Striano et al. | 340/815.4 |
| 2003/0145802 | A1 | 8/2003 | Morgan | |
| 2003/0151926 | A1 | 8/2003 | Mermaz et al. | |
| 2004/0038582 | A1 * | 2/2004 | Clement | 439/467 |
| 2005/0024884 | A1 | 2/2005 | Seminara et al. | |
| 2005/0057942 | A1 | 3/2005 | Mako et al. | |
| 2005/0057943 | A1 | 3/2005 | Mako et al. | |
| 2007/0091590 | A1 * | 4/2007 | Von Czenkow | 362/103 |
| 2007/0103890 | A1 * | 5/2007 | Morehead | 362/103 |
| 2008/0089056 | A1 * | 4/2008 | Grosjean | 362/103 |
| 2008/0168941 | A1 | 7/2008 | Haynes | |
| 2009/0067159 | A1 | 3/2009 | Beneski et al. | |
| 2009/0244893 | A1 * | 10/2009 | Villard | 362/246 |
| 2010/0008090 | A1 * | 1/2010 | Li et al. | 362/249.03 |
| 2010/0253501 | A1 * | 10/2010 | Gibson | 340/475 |
| 2010/0277943 | A1 | 11/2010 | Hurwitz | |
| 2011/0121971 | A1 * | 5/2011 | Ross | 340/541 |
| 2012/0033411 | A1 * | 2/2012 | Heo | 362/108 |
| 2012/0130455 | A1 * | 5/2012 | Baird et al. | 607/90 |

FOREIGN PATENT DOCUMENTS

| | | | |
|---|---|---|---|
| EP | 129920 | A | 1/1985 |
| EP | 860801 | B1 | 4/2004 |
| EP | 1410725 | A | 4/2004 |
| EP | 1597980 | A | 11/2005 |
| EP | 1090252 | B1 | 9/2010 |
| GB | 2045914 | A | 11/1980 |
| GB | 2336096 | A | 10/1999 |
| GB | 2382612 | A | 6/2003 |
| GB | 2388766 | A | 11/2003 |
| GB | 2392768 | A | 3/2004 |
| JP | 8041706 | A | 2/1996 |
| JP | 8126514 | A | 5/1996 |
| JP | 9209204 | A | 8/1997 |
| JP | 2000054206 | A | 2/2000 |
| JP | 2001123304 | A | 5/2001 |
| JP | 2003118533 | A | 4/2003 |
| JP | 2004232369 | A | 8/2004 |
| JP | 2006176893 | A | 7/2006 |
| JP | 2010126820 | A | 6/2010 |
| WO | 9749948 | A2 | 12/1997 |
| WO | 9967568 | A | 12/1999 |
| WO | 2007047187 | A | 4/2007 |
| WO | 2007071251 | A | 6/2007 |
| WO | 2008043103 | A | 4/2008 |
| WO | 2009049441 | A1 | 4/2009 |

* cited by examiner

304

SAFETY DIRECTIONAL INDICATOR

BACKGROUND OF THE INVENTION

1. Field of the Invention

The present invention relates to devices for improving highway safety. Provided is a safety directional indicator for pedestrian and motor vehicle traffic, as well as for first responders. Embodiments include devices for guiding a driver of a vehicle or a pedestrian in a desired direction, typically away from first responders, highway workers, curbs, opposing lanes of traffic, or other dangerous situations.

2. Description of Related Art

Driving a motor vehicle or walking along roadways at night and during inclement or lowlight conditions can be dangerous and difficult for drivers, pedestrians, highway workers, and first responders. A common situation where accidents can occur involves turning into the correct lane of traffic, especially in divided highway situations. As is well known, a difficult driving task is presented by trying to turn and enter a correct lane while staring into headlights, being sidetracked by traffic lights, parking lot lights and other distractions such as construction sites and locations where emergency personnel and vehicles are present. This difficulty is further magnified in a multi-lane roadway environment. Many well-traveled and worn roadways lack the proper lines and lighting that would otherwise allow a driver to properly view his/her lane during turns in an intersection. Likewise, pedestrian crosswalks suffer from similar lighting deficiencies and/or worn pathways. Furthermore, many conventional in-vehicle navigational guidance devices, displaying a map with optional voice indicated directions, are not helpful enough for the driver to decide which lane to take and may actually distract driver's attention from observing the intersection layout and traffic conditions.

Another common situation where highway safety is an issue is where first responders to an accident scene are present. In addition to the dangerous conditions present which caused an accident in the first place, there may be present first responders to assist with emergency needs. Visibility of the first responders is helpful in directing traffic away from those individuals, however, visibility of the individuals themselves may not always be possible depending on the road or environmental conditions of a particular accident scene. Thus there is a need for increasing the visibility of first responders to others, especially drivers maneuvering through an accident scene during the emergency.

Known highway safety devices include stationary and portable devices for illuminating subjects, structures, and/or the correct driving or walking path. For example, US Published Patent Application No. 20080168941, entitled "Apparatus and method for guiding driver of a motor vehicle to enter a correct lane after a turn at an intersection," discloses an apparatus for guiding a driver of a vehicle to enter a correct lane after a turn at an intersection, the disclosure of which is hereby incorporated by reference herein in its entirety. The device comprises: (a) an elongated housing having a predetermined length; (b) means for mounting a first end of said housing to a ground surface so that said housing is disposed in a generally upright manner; and (c) means secured to said housing for indicating said correct entry lane and viewable by said driver prior to and during turning into said correct entry lane. This device directs traffic to follow a desired path using an obtrusive structure that stands upright on a ground surface and is readily noticeable by drivers. In embodiments, colored lights are used to indicate the correct path to follow, such as green and red. Although this device is useful for some situations, a smaller, more portable device that can be used in a variety of locations and for a variety of situations is more highly desired.

Similarly, U.S. Pat. No. 6,146,006, which is a "Method and Apparatus for Light Transmission," describes a flexible and portable apparatus (belt or vest) comprising light sources and flexible hot-melt adhesive thermoplastic material with light transmission characteristics for transmitting a flashing light from the light sources. The disclosure of U.S. Pat. No. 6,146,006 is hereby incorporated by reference herein in its entirety. The light sources are disposed at both ends of the thermoplastic material such that light travels to the center of the material and creates a flashing effect as the light sources are turned on and off at the same time. This apparatus is intended to be worn by highway personnel to increase visibility of highway workers to drivers. As such, the device has limited applicability to other highway safety issues, such as for indicating a proper direction for drivers and pedestrians.

Thus, what is desired is a multi-functional safety device that is portable, easy to install, and can be used for a variety of highway safety situations, including as a directional indicator for drivers and pedestrians as well as protective clothing for highway personnel and first responders.

SUMMARY OF THE INVENTION

An object of the safety devices according to embodiments of the invention is to increase driver awareness of highway situations, especially during conditions of restricted visibility. Situations where visibility can be limited or distracting to a driver and/or pedestrian traffic can include inclement weather, such as rain, fog, or snow, construction sites where the roadway has been altered or where construction personnel and equipment may be located, and emergency sites where emergency personnel and equipment are present in order to attend to accident clean up and/or to attend to accident victims. It is highly desirable to have a single device or system that is capable of alerting drivers to a variety of dangerous conditions including that personnel are present on the highway, that there is a specific traffic path to be followed, and/or that there exists a dangerous structural condition that drivers should avoid.

Specifically included in embodiments of the invention is a safety directional indicator system comprising a flexible belt with a plurality of light transmitting bars disposed along the belt and having a plurality of LEDs disposed at one elongated end of each light transmitting bar and in operable communication with a control system for illuminating the LEDs. Safety devices according to the invention can be stand-alone devices, devices capable of being attached to objects or structures at a highway scene, or configured to be worn on a person's body. Highly desired is a flexible strip which can be used in each of these situations.

A preferred embodiment according to the invention is a safety directional indicator comprising: (i) a flexible substrate strip; (ii) a plurality of light conducting rods disposed parallel to one another and along the length of the substrate; (iii) a plurality of LEDs, each disposed at the base of a light conducting rod; and (iv) a control module comprising a power source in operable communication with the LEDs and operably configured to turn on and off the LEDs in a sequential manner. The safety belts of embodiments of the invention preferably comprise one or more clips, which render the safety belts modular.

Included in the scope of the invention is a clip system for a safety belt comprising: a plurality of electrically conductive clips each comprising a releaseably engageable buckle, teeth for securing a belt within the buckle, and plug and socket end in operable communication with the teeth by way of an electrical circuit; a plurality of terminal clips comprising at one end a D-ring type buckle and at an opposing end a plug and socket configured for engagement with the plug and socket end of the electrically conductive clips.

Safety directional indicators can also be used to indicate the correct path for pedestrians to follow especially in situations of low light conditions or temporary construction sites. Often times it may not be feasible to install permanent lighting to illuminate pedestrian walkways but not having proper light can lead to pedestrian deaths. The invention provides safety directional indicators that can be installed quickly and inexpensively and used permanently or on a temporary basis. One use for the safety directional indicators with respect to pedestrian traffic is to place strips of the directional indicators along crosswalks. The devices can be configured to be modular in that they can be operably connected one with another end to end to provide a desired overall length of the lighting system. This avoids the cost of custom systems for particular situations. The safety directional indicator strips can be oriented in a manner to provide the appearance of a chasing pattern of light along the length of the substrate strips and thus the overall length of the system. This chasing pattern of light indicates to the pedestrian the direction to follow to cross the street safely. Simultaneously, by illuminating the crosswalk in a dynamic fashion, the crosswalk is made highly visible to drivers.

Safety directional indicators can also be used to increase the visibility of first responders and road workers present on a road scene. For example, the directional indicators can be configured to be worn by first responders so that their presence on an accident scene may be readily acknowledged by drivers, especially drivers maneuvering through an accident scene during the process of clean up and/or administration of assistance.

The present invention also relates to methods of using the inventive safety directional indicator systems. For example, provided is a method of indicating a path for a driver or pedestrian to follow comprising: (a) providing a safety directional indicator comprising a flexible belt with a plurality of light transmitting bars disposed in parallel along the length of the belt and a plurality of LEDs each disposed at one end of each light transmitting bar and each operably connected with a control module for turning the LEDs on and off sequentially; (b) installing the safety directional indicator on a surface of a structure such that upon illumination of the LEDs and each light transmitting bar a direction to follow is indicated by a chasing pattern of light along the length of the belt; and (c) providing power to the safety directional indicator.

Other objects of the present invention include providing an apparatus for directing a driver of a motor vehicle to enter a correct lane after a turn at an intersection. Preferred embodiments may include a turn and/or lane entry guidance apparatus that emits light having a chasing pattern to indicate the correct or safe direction to follow. Yet another object of the present invention is to provide a directional indicator device that can be installed easily at the intersection without the need for utility work. A further object of the present invention is to provide a turn and lane entry guidance apparatus that incorporates a source of electric power in order to avoid electrical utility work. Yet a further object of the present invention is to provide a turn and lane entry guidance apparatus that also indicates the incorrect entry lane. Another object of the invention is to provide a method of guiding a driver of a vehicle to enter a correct lane after a turn at an intersection by employing the above described apparatus.

The features of novelty and various other advantages that characterize the invention are pointed out with particularity in the claims forming a part hereof. However, for a better understanding of the invention, its advantages, and the objects obtained by its use, reference should be made to the drawings that form a further part hereof, and to the accompanying descriptive matter, in that there is illustrated and described a preferred embodiment of the invention. The features and advantages of the present invention will be apparent to those skilled in the art. While numerous changes may be made by those skilled in the art, such changes are within the spirit of the invention.

BRIEF DESCRIPTION OF THE DRAWINGS

These drawings illustrate certain aspects of some of the embodiments of the present invention, and should not be used to limit or define the invention.

DETAILED DESCRIPTION OF PREFERRED EMBODIMENTS

According to embodiments of the invention, provided are devices for indicating to drivers and pedestrians the correct driving or walking path. The safety directional devices and systems comprising them are preferably configured in a manner to allow use of the devices as wearable safety gear or as installed on the surface of a highway structure.

Embodiments include a safety directional indicator system comprising: a flexible belt; a plurality of elongated light transmitting bars disposed in parallel along the belt; a plurality of LEDs disposed at one elongated end of each light transmitting bar; wherein the plurality of LEDs are in operable communication with a control system for illuminating the LEDs.

Figure 1:
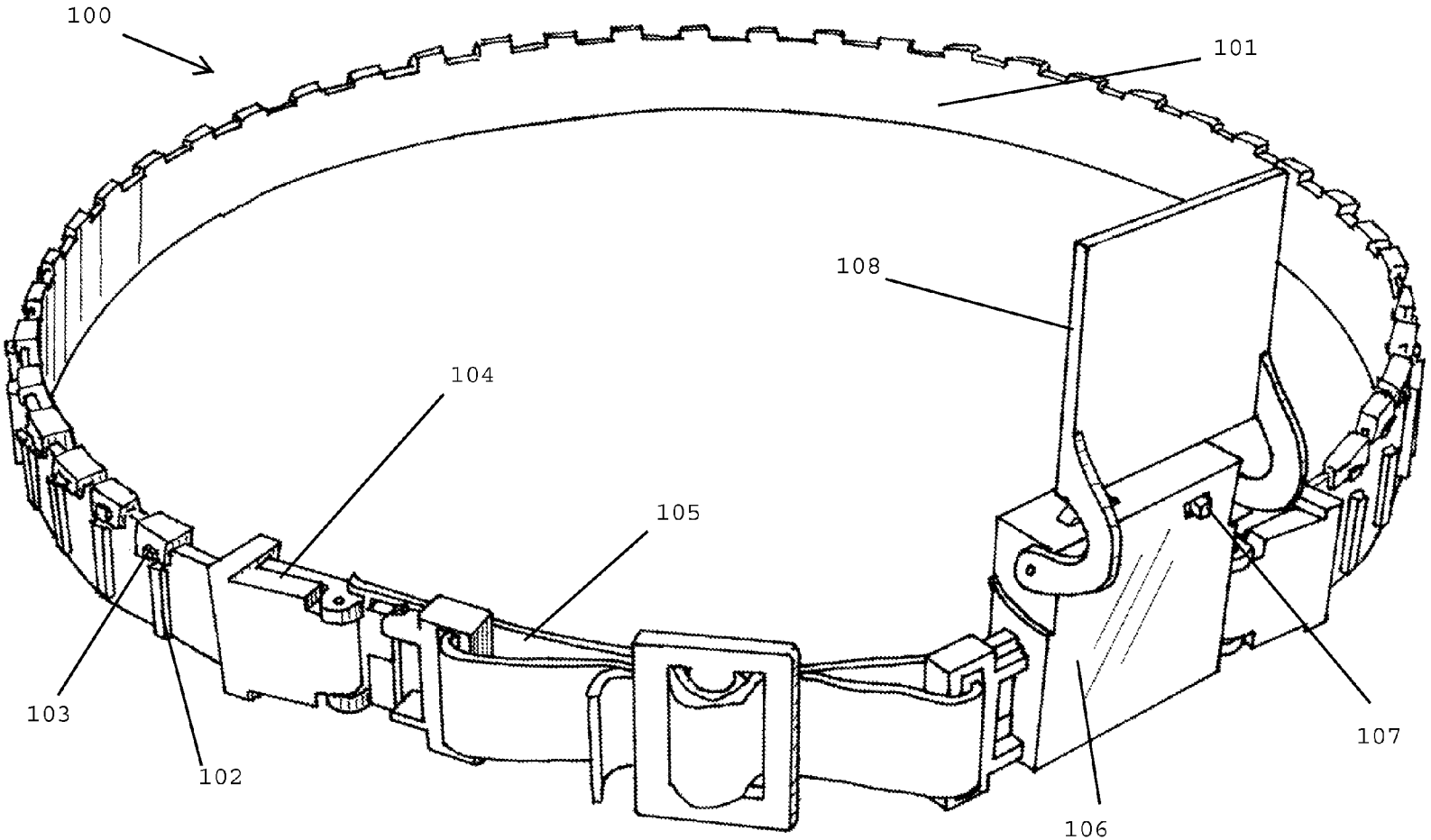
FIG. 1 is an illustration showing a front perspective view of an embodiment of a safety directional indicator according to the invention.

As shown in FIG. 1, a belt 100 is provided as a safety directional indicator system. The belt comprises a flexible substrate strip 101, which can be comprised of any material so long as the overall belt is flexible. Preferred materials for the belt include leather, plastic, and cloth. Especially preferred are materials that will be durable and long lasting including reinforced cloth, such as tightly weaved cloth used for motor vehicle seat belts. Metal can also be used for the elongated substrate strip, so long as the metal has some flexibility. Chain link metal can also be used. Exemplary indicator systems can comprise any length belt, such as from 1 foot, or 2, 3, 4, 5, or 6 feet in length or larger. Total length of the belt will be dependent on the particular application for which it is used and the distance needed to cover. Multiple strips of belt can be connected together to create longer segments and longer modular strips of belt can be shortened by removing one or more segment.

The substrate strip (belt) can comprise means for securing the belt to a person, such as a buckle 104. Additionally, the belt can be adjusted to fit various people by way of adjusting means 105.

Attached to the substrate strip or belt is a plurality of elongated light transmitting bars 102. The light transmitting bars can be made of any light transmitting material, including plastic, acrylics (polymers of PMMA), acrylic resin, polycarbonate, epoxies, and glass. Appropriate materials can include those manufactured under the brand names of Lucite®, Plexiglas®, Acrylite®, Perspex®, and Rohaglas® to name a few. Further, technical information concerning the principles of light transmission, light guides and light pipes can be found in "Light Guide Techniques Using LED Lamps," by Agilent Technologies, 2001, which is incorporated by reference herein in its entirety.

Preferred properties of the light guides used according to the invention include that light is transmitted through the material from one end to the other and is allowed to escape the light bar along the length of the light bar. For example, in preferred embodiments, the light transmitting bars are square or rectangular cylinders within which light entering one end of the cylinder passes through the light bar by internal reflection. Any shape cylinder can be used including for example light rods with a triangular or circular cross section. Something less than total internal reflection is desired for the safety directional indicators of the present invention. More particularly, 50%-90% internal reflection is highly desired, with 50%-75% internal reflection being especially preferred. In such configurations, 10%-50% of the light entering one end of the light bar is allowed to escape the sides of the light bar, which provides for the effect of illuminating the entire bar along its length not just passing the light through the bar to the opposing elongated end of the light bar.

The principles of Frustrated Total Internal Reflection (FTIR) can be used to ensure a sufficient amount of light is allowed to escape the light transmission medium. For example, if one side of the light bar is in contact with a material having a higher refractive index than the light bar, then the light will be refracted instead of reflected. When refracted the light will escape the light bar through the side opposing the side that is in contact or in near contact with the material of higher refractive index.

Preferred materials have a refractive index ranging from about 1.4-1.5. For example, polymethylmethacrylate is a preferred material for the light bars, which is highly transparent and has a light transmittance of greater than 92% in the visible range of 380 nm to 780 nm, and a refractive index of about 1.492. Acrylic light bars used according to the invention can be cast or extruded.

At the base of each light rod is disposed an LED 103. The LEDs can be of any type, including high brightness, SMD, SMT, ultra-thin, or through-hole type LEDs to name a few. Further, flexible strips comprising LEDs can also be used, especially modular strips that can be cut or adapted to fit any particular length needed. The LEDs can have a viewing angle ranging from about 30° to about 120°. The LEDs can be white, colored, or a combination thereof. The LEDs can have a brightness ranging from about 8 lumens to about 110 lumens depending on the application. A lens can be used between the LEDs and the light rods to focus the light from the LED into the light rod so that little loss in flux occurs. The belts can comprise any number of LEDs and each can comprise, for example, 10, 20, 50, or 100 LEDs. Typically, one LED is used for each light bar, but more or less can be used. In addition, other LEDs can be used on the safety belt without a corresponding light bar. The belts can be configured for interconnection with other belts to form longer series of LEDs and light bars. For example, the belts can comprise or can be interconnected to comprise 5 LEDs, 30 LEDs, 80 LEDs, and higher, such as 300 LEDs.

Any type of LED can be used in the safety belts according to the invention, however, particular types of LEDs will usually be dictated by a specific application. Appropriate LEDs include high brightness PLCC-2 SMD LEDs and PLCC-6 SMD LEDs. Likewise, 3528 SMD LEDs may be used as well as 5050 RGB SMD LEDs for particular applications. LEDs with any viewing angle may be used, such LEDs having a 120 degree viewing angle for even light. Viewing angles of about 60-90 degrees may be preferred to direct the light into the light bars. White or colored LEDs can be used, including without limitation white (neutral, cool, and warm), red, yellow, blue, and green. The safety belts of the invention can comprise any number of single-color or multi-color LEDs, or any combination thereof. In embodiments, the light belts can comprise single-color red, yellow, green, blue, cool white, neutral white, or warm white and/or multi-color (RGB-color) red, green, and blue colored LEDs. Any color combination is possible and within the ordinary skill of the art. Even further, 0.5 W SMD LEDs or 0.5 W SMD PLCC-2 LEDs or 0.5 W SMD PLCC-6 LEDs can be used in embodiments.

Ultra-Bright LEDs can also be used, such as Cree XLamp™ Extremely high-brightness LED, which is capable of operating at 1 Watt and above. Such LEDs are characterized by having a long-life, solid-state, low-voltage and current light. The LEDs, such as this one, can be mounted on a heatsink (e.g., star-type aluminum disc) with solder spots provided to simplify connection. Such LEDs have a 100 degree viewing angle; a maximum forward voltage of 4 Vdc; and a maximum current of 350/700 mA. Another LED from CREE, Inc. is the XLamp® XB-D LED, which can be used in embodiments of the invention. The XB-D LED delivers twice the lumens-per-dollar of other LEDs and in a small footprint of 2.45 mm×2.45 mm. The XB-D LED delivers up to 139 lumens and 136 lumens per watt in cool white (6000K) or up to 107 lumens and 105 lumens per watt in warm white (3000K), both at 350 mA and 85° C. The LEDs can also be waterproof, or when disposed on the safety belt, disposed in a manner to render the LEDs and the lighting system waterproof.

Typically, the LEDs will be electrically connected with a control module 106. Electrical connection can be accomplished using a printed circuit board (preferably module and flexible) or by way of electrical leads. Preferably, a printed circuit board is used in combination with circuitry and software for programming the lights to turn on and off in a chasing fashion. What is meant by "chasing" in the context of this specification is that a first LED will turn on and then it will turn off when a second LED is turned on, then the second LED is turned off when a third LED is turned on and so on. In this manner the light will appear to be travelling along the length of the belt from one LED/light bar to the next. The control module can be equipped with an on/off switch 107 and optionally a solar panel 108 for providing solar power to the control module for operation or for charging a battery within the control module. An electrically rechargeable battery or other convention power source can also be used.

In embodiments, the Light Strap is comprised of a customizable strip which comprises the LEDs and Acrylic indicators and two connector tabs, one of which is attached to a control module. The connector tab that is not connected to the control module is simply a jumper to connect all the electric leads to a ground completing the circuit. The connector tab that is connected to the control module is in operable communication therewith in such a manner as to send an electronic pulse to the strip by way of the connector pin to control which LEDs light at a particular time. The connector pin is a pointed metal part that bites through the wire insulation into the wire to create an electrical connection. The width of the strip dictates the number of leads possible for the strip. In a preferred embodiment, there are 7 leads, 6 positive and one ground. The first lead would control the $1^{st}$, $7^{th}$, $13^{th}$ and so on LED's. The second lead would control the $2^{nd}$, $8^{th}$, $14^{th}$ and so on LEDs, and the same through the other leads. A flash sequence of the number 1,2,3,4,5,6, LEDs would also cause the 7,8,9,10,11, 12 LEDs to flash as well at the same time for the length of the strip giving the illusion of directional movement and an indication of desired direction. More particularly, in such "chasing" type embodiments, LEDs 1, 7, 13 (and every first LED in a set of six LEDs) would flash on at the same time. Then LEDs 1, 7, 13, etc. are turned off, while LEDs 2, 8, 14, etc. are flashed on. Then LEDs 2, 8, 14, etc. are turned off, while LEDs 3, 9, 15, etc. are turned on. This flashing on and off pattern continues until each LED in each set of six LEDs has flashed on, then the pattern repeats by beginning again at LEDs 1, 7, 13, etc. Any combination of any number of flashing LEDs is possible, including flash sequences for non-directional indication.

The substrate strips or belts can be configured to be mated with additional substrate strips to obtain a longer system. In one embodiment, one end of the substrate strip can be electrically and physically connected to the end of another strip and so on. For example, the technology of US Published Patent Application No. 2010-0008090, entitled "Modular LED Lighting Systems and Flexible or Rigid Strip Lighting Devices," and which is incorporated by reference herein in its entirety, can be incorporated into the safety belts and flexible substrate strips of this invention. As such the safety systems of the present invention can be modular and provide for any length substrate system needed for a particular application.

In preferred embodiments, the control system is operably configured for turning the LEDs on and off in a sequential manner. What is meant by sequential in the context of this specification is that as one LED is turned on the LED just prior to it is turned off. The sequence of turning on and off the LEDs can be accomplished relative to the entire length of the substrate and/or the entire length of the system of multiple substrate strips. Groups of LEDs can be activated and deactivated simultaneously, such that the overall system, especially if of an increased length, provides the appearance that several sections of LEDs are illuminated in a chasing pattern along the length of the system.

The safety directional indicators of the present invention can further comprise means for securing the belt to a surface. Preferably such securing means is disposed along the length of the belt or strip on a side opposite where the light transmitting bars are disposed. Means for attaching the device or system to a surface include using adhesive, snaps, hook and loop fasteners or staples. Cement anchors can be used to secure the strips to a curb, while staples or nails may be used to secure the strips to a wooden sign post. Adhesive is generally an all purpose type of securing means as it may be used to adhere the substrate strip to a cement curb, or a wooden post or building, or a metal sign. One skilled in the art will know which means is most appropriate for securing the system in place for operation.

Embodiments of the invention include a safety directional indicator comprising: a flexible substrate strip; a plurality of light conducting rods disposed parallel to one another and along the length of the substrate; a plurality of LEDs each disposed at the base of a light conducting rod; and a control module comprising a power source in operable communication with the LEDs and operably configured to turn on and off the LEDs in a chasing pattern.

Preferably, the devices are configured such that each device is operably connected with another such device to obtain a continuous system, which is operably configured to turn on and off the LEDs in a chasing pattern along the length of the system.

Even further, the safety directional indicator can be joined electrically and physically to the end of another such device in a manner to provide a chasing pattern of light along the length of the system.

The safety straps are useful for many situations, including for road crews and first responders. Road crews and first responders have the daunting task of working in hot, loud, dangerous environments, and have the added danger of being in dose proximity to several ton vehicles traveling down the road at 60+ miles an hour. The current safety garments are neon colors or reflective, both requiring the wearer to be in sight of the driver. Due to congestion, increasingly, construction is done in the evening or at night further decreasing visibility down to the people in the driver's headlights. The wearable connector of the safety strap could be worn on the helmet or around the waist like a belt giving extra precious seconds to be seen and preventing accidents.

Figures 2A, 2B:
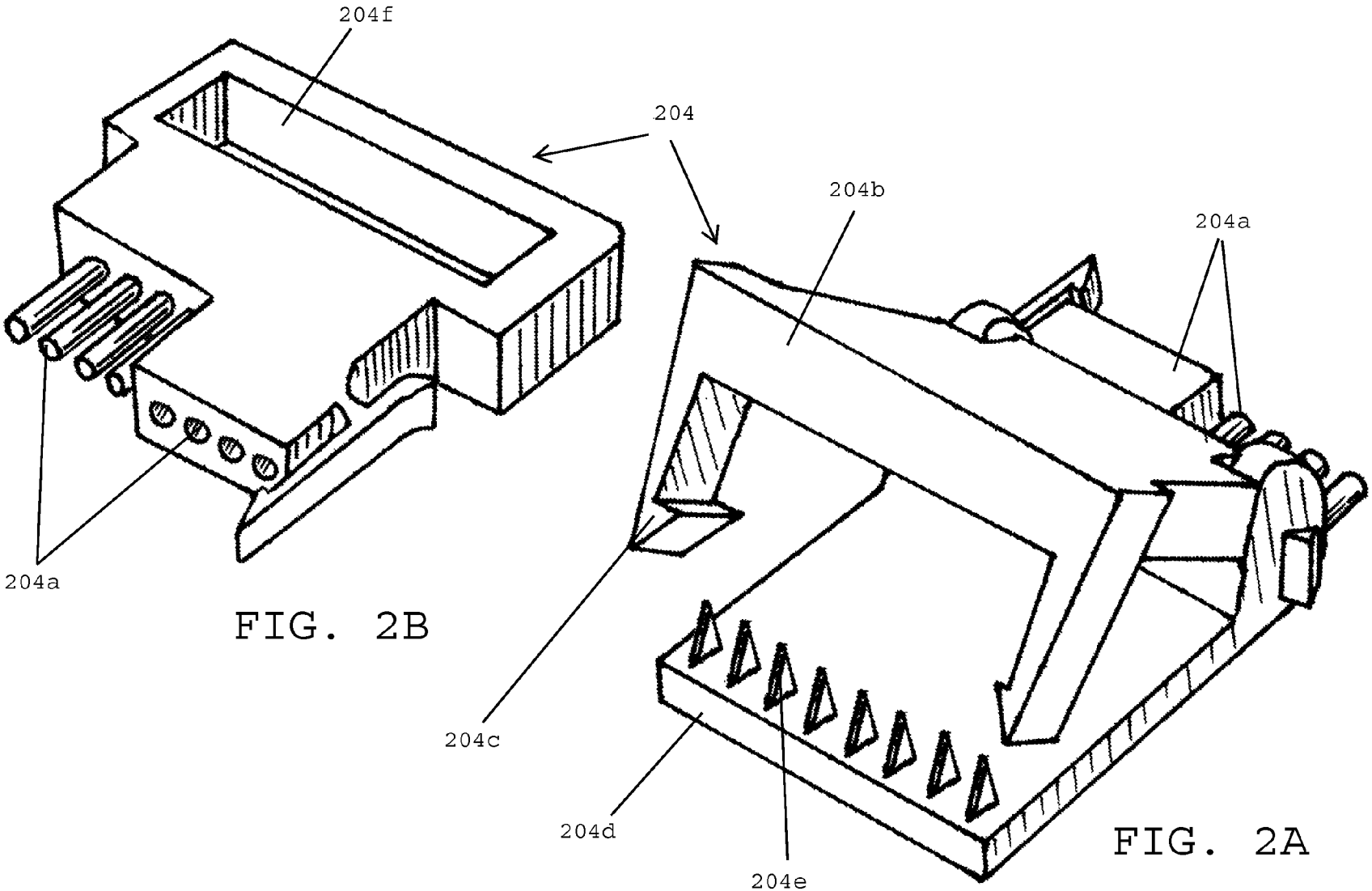
FIGS. 2A-B are drawings showing a perspective view of a clip embodiment according to the invention.
Figure 3A:
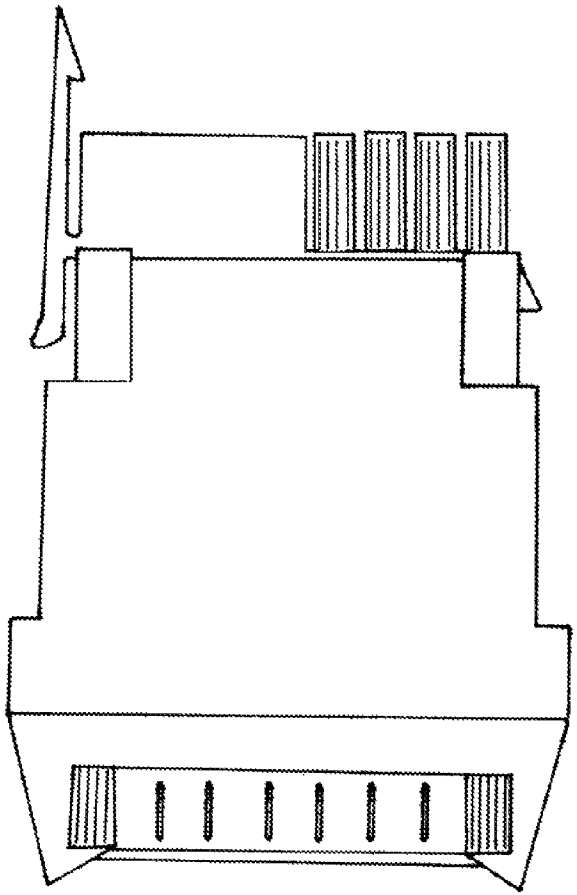
FIGS. 3A-B are drawings showing a top planar view of the clip embodiment illustrated in FIGS. 2A-B.

FIGS. 2A-B and 3A-B are drawings showing clip embodiments according to the invention. More particularly, FIG. 2A shows a clip having "teeth" to bite into the end of the safety belt and transfer signals from the control module to the belt. In embodiments, the control module is operably connected with the clip by way of a plug and socket type connection, 204*a*. It is not critical whether the control module or the clip comprises the plug or socket. As shown, it may be desirable for each of the control module and the clip to comprise a plug and a socket for interconnection with a socket and plug on the other component. In this manner, the safety belt comprises an electrically conductive pathway (such as electrically conductive material or fibers or a printed circuit) which can be secured into the clamp using buckle 204*b*. When closed, the buckle 204*b* is releaseably connected by way of a locking mechanism 204*c* with an opposing buckle portion 204*d*. The belt is retained in the clip by pressure or the clip can additionally comprise teeth 204*e* which penetrate the fibers of the belt and provide means for preventing pullout of the belt from the clip. The teeth 204*e* are preferably oriented in a direction that enables insertion of one end of the belt lengthwise into the clip. The teeth 204*e* are also operably connected with an electrical circuit incorporated into the clip which is operably connected with the terminal end 204*a*. As such, an electrical charge can move from the power/control module into a clip then into the belt to illuminate the LEDs disposed along the length of the belt. This clip can also be used to connect together two belts by taking two clips, rotating one 180 degrees and plugging it into the other and then clipping the resulting pair to two belts. This type clip carries signals and current from the power and control module and can be color-coded red for ease of identification and to promote caution. FIG. 3A provides a top planar view of the clip of FIG. 2A.

Figure 3B:
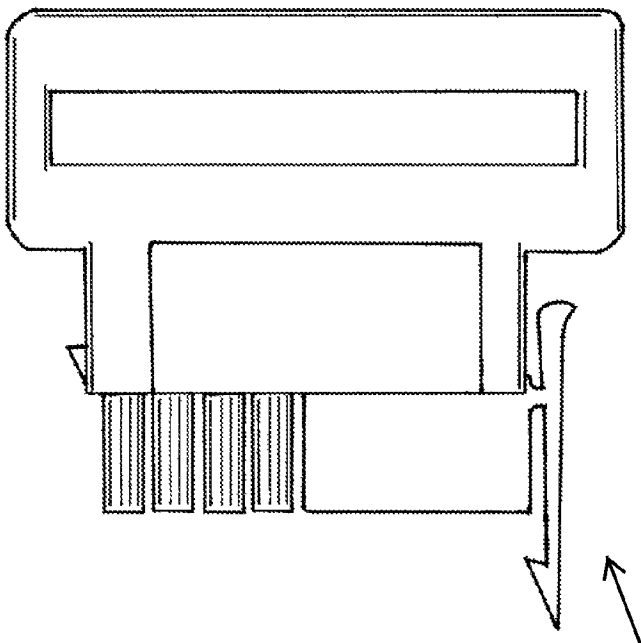

FIG. 2B is another embodiment of a clip according to the invention. The clip shown in FIG. 2B has a connection end 204*a* that is the same as that shown on the clip in FIG. 2A. This clip, however, only functions as way of connecting the clip to a belt assembly and does not transfer electricity. For convenience and ease of use, such a clip in the safety belt systems of the invention can be color-coded yellow. This clip is optional within systems of the invention and merely provides a platform (typical D-ring buckle 204*f*) for adjusting belt size. Preferably, all clips used in a particular system according to the invention have the same connection means 204*a*, which is universal to the system and provides for modularity and interchangeability of the components of the system. FIG. 3B provides a top planar view of the clip of FIG. 2B.

Figure 4:
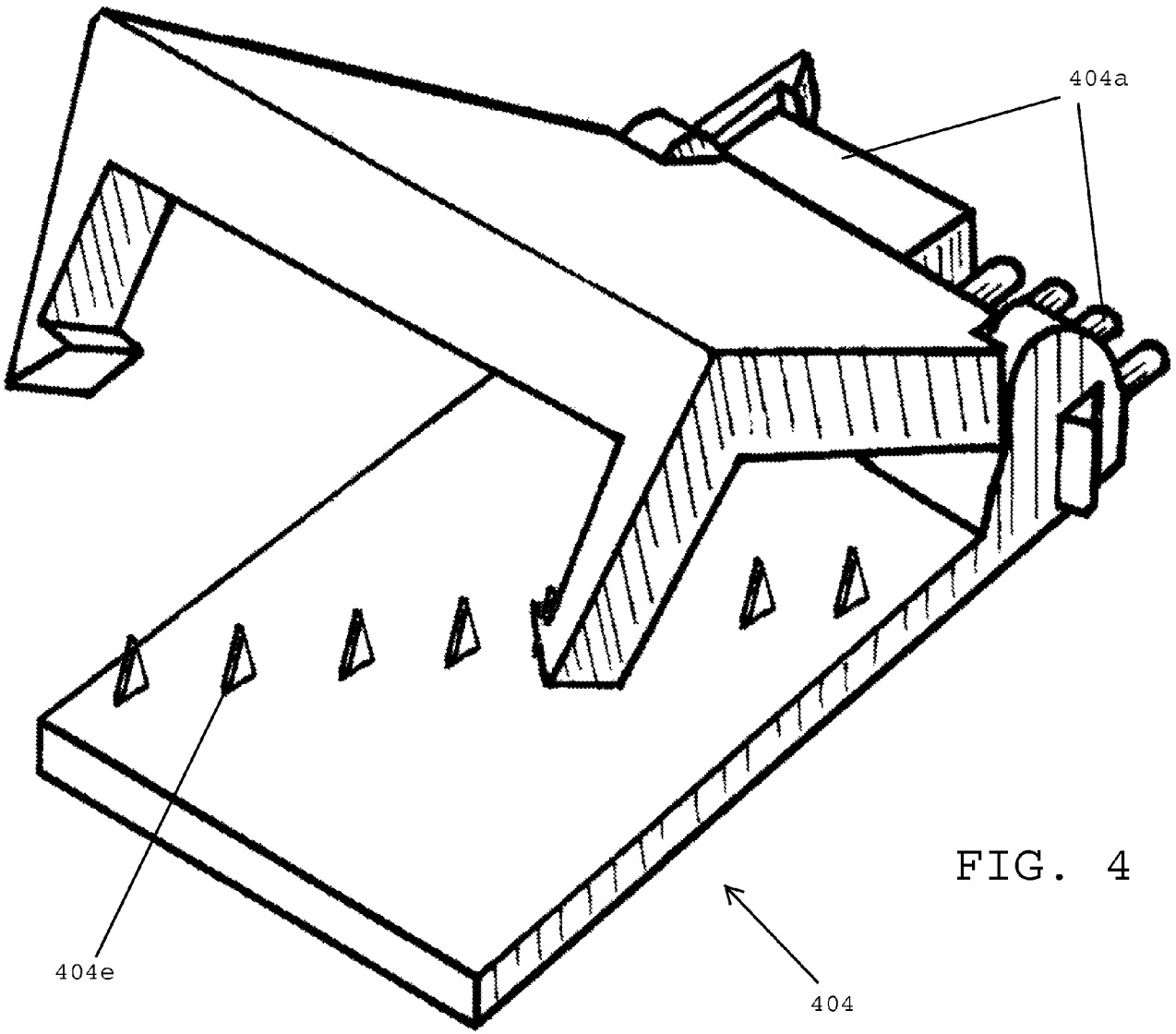
FIG. 4 is drawing showing another clip embodiment of the invention.

FIG. 4 shows another clip embodiment of the invention. In particular, the clip shown in FIG. 4 connects to the safety belt at a 90 degree angle or from the side of the belt, and transfers the signals from the power/control module to the belt. In this manner, teeth 404*e* are disposed on or are incorporated into the clip in a manner that prevents release of the belt in a direction that is normal to the clip. The teeth 404*e* are operably connected with a circuit incorporated into the clip which is operably connected with electrical contacts 404*a*. This clip can also be used to connect together two belts at 90 degrees by using the third type to connect to the belt and plugging first type into it and clipping the first type to the belt. This type of clip carries signals and current and can be color-coded orange for ease of identification and to promote caution.

In safety belt systems of the invention and referring back to FIG. 1 for example, a safety belt can comprise a power/control module, one or more belts having an electrical pathway operably connected with a plurality of LEDs along the length of the belts, and one or more clips for connecting the belts to the power source, or to one another. As shown in FIG. 1, a representative safety belt can comprise a control module 106, which is in direct operable communication with a clip 104. Here, the power source/control module is connected with a clip 104 by way of a plug and socket type connection. In embodiments, the plug and socket connection comprises two pathways to ground and six pathways for delivering the electrical signal from the control module through the clip and into the belt. The clip 104 is then operably connected to the safety belt 101 mechanically and electrically. A plurality of LEDs 103 are disposed along the length of the belt and provide light to a plurality of light bars 102 disposed perpendicular to each LED along the length of the belt. At the opposing end of the belt is another clip 104 which is secured to the belt. This clip is then connected with a terminal clip 104 which is connected with a strap for adjusting the size of the belt, which is in turn connected with another terminal clip 104, either incorporated into the control module or operably connected therewith in a releaseable manner, such as by using the universal plug and socket connection that is used for all of the other clips of this system.

In yet other embodiments, the directional indicators or otherwise referred to as the safety strap can be used to provide power to a bulb disposed on a barrel. For example, it is common for highway workers to place a barricade of barrels along the roadway to guide drivers safely through a construction zone. Typically, on the top of the barrel is placed a light fixture which is used to provide additional guidance to the driver. The safety straps of the invention can be used in combination with such barrels by placing the safety strap around the circumference of a barrel and then electrically connecting the safety strap to the light fixture to provide electrical power to the light on the barrel. The safety strap can illuminate in its normal fashion and with the additional light provided by the light on the barrel, the combination can provide optimum directional indicator capabilities.

Methods of using the safety devices are also encompassed by the present invention. For example, provided is a method of indicating a path for a driver or pedestrian to follow comprising: providing a safety directional indicator comprising a flexible belt with a plurality of light transmitting bars disposed in parallel along the length of the belt and a plurality of LEDs each disposed at one end of each light transmitting bar and each operably connected with a control module for turning the LEDs on and off sequentially; installing the safety directional indicator on a surface of a structure such that upon illumination of the LEDs and each light transmitting bar a direction to follow is indicated by a chasing pattern of light along the length of the belt; and providing power to the safety directional indicator.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. It is intended that the specification and examples be considered as exemplary in nature and that variations that do not depart from the essence of the invention are intended to be within the scope of the invention.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present invention. While devices and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A safety directional indicator system comprising:

a flexible belt;

a plurality of elongated light transmitting bars, each light transmitting bar in the plurality with a first and second end, and each light transmitting bar disposed in parallel along the belt such that the longest side of one light transmitting bar is disposed parallel to the longest side of another light transmitting bar in the plurality and each light transmitting bar is disposed between a first and second edge of the flexible belt;

a plurality of LEDs wherein each LED in the plurality is disposed at the first end of each light transmitting bar such that there is an equal number of LEDs as light transmitting bars;

wherein each LED is disposed between the first end of one light transmitting bar and the first edge of the flexible belt; and the first and second end of the light transmitting bar is disposed between the LED and the second edge of the flexible belt such that the light transmitting bar is separated from the LEDs while still allowing transmission of light from the LEDs through the light transmitting bar;

wherein the plurality of LEDs are in operable communication with a control system for illuminating the LEDs.

2. The safety directional indicator of claim 1, wherein the control system is operably configured for turning the LEDs on and off in a sequential manner.

3. The safety directional indicator of claim 1 further comprising a solar panel in operable communication with the control module for providing power to the system.

4. The safety directional indicator of claim 1 further comprising means for securing the belt to a surface.

5. The safety directional indicator of claim 4 comprising a buckle for securing the belt to a person.

6. The safety directional indicator of claim 4, wherein the means for securing the belt to a surface is disposed along the length of the belt on a side opposite where the light transmitting bars are disposed.

7. The safety directional indicator of claim 4, wherein the means for securing the belt to a surface comprises at least one of adhesive, snaps, hook and loop fasteners or staples.

8. A safety directional indicator comprising:

a flexible substrate strip with a first and second edge;

a plurality of light conducting rods, each light conducting rod in the plurality with a first and second end, and each light conducting rod disposed parallel to one another and along the length of the flexible substrate strip such that the longest side of one light conducting rod is disposed parallel to the longest side of another light conducting rod in the plurality and each light conducting rod is disposed between the first and second edge of the flexible substrate strip;

a plurality of LEDs wherein each LED in the plurality is disposed at the first end of a light conducting rod;

such that there is an equal number of LEDs as light conducting rods;

wherein each LED is disposed between the first end of one light conducting rod and the first edge of the flexible substrate strip; and the first and second end of the light conducting rod is disposed between the LED and the second edge of the flexible substrate strip such that the light conducting rod is separated from the LEDs while still allowing transmission of light from the LEDs through the light conducting rod;

and a control module comprising a power source in operable communication with the LEDs and operably configured to turn on and off the LEDs in a chasing pattern.

9. The safety directional indicator of claim 8 comprising means for operably connecting the safety directional indicator with another such safety directional indicator such that a continuous system is obtained and the continuous system is operably configured to turn on and off the LEDs in a chasing pattern along the length of the continuous system.

10. The safety directional indicator of claim 9, wherein one or more safety directional indicator devices is joined electrically and physically to the end of another such device in a manner to provide the chasing pattern of light along the length of the continuous system.

11. A method of indicating a path for a driver or pedestrian to follow comprising:

providing a safety directional indicator comprising a flexible belt with a plurality of light transmitting bars, each light transmitting bar in the plurality with a first and second end, and each light transmitting bar disposed in parallel along the length of the belt and a plurality of LEDs each disposed at the first end of each light transmitting bar such that one LED is used for each light bar and each operably connected with a control module for turning the LEDs on and off sequentially such that the longest side of one light transmitting bar is disposed parallel to the longest side of another light transmitting bar in the plurality and each light transmitting bar is disposed between a first and second edge of the flexible belt, wherein each LED in the plurality is disposed between the first end of one light transmitting bar and the first edge of the flexible belt; and the first and second end of the light transmitting bar is disposed between the LED and the second edge of the flexible belt such that the light transmitting bar is separated from the LEDs while still allowing transmission of light from the LEDs through the light transmitting bar;

installing the safety directional indicator on a surface of a structure such that upon illumination of the LEDs and each light transmitting bar a direction to follow is indicated by a chasing pattern of light along the length of the belt; and providing power to the safety directional indicator.

12. The safety directional indicator of claim 1 comprising:

a clip system for connecting opposing ends of the flexible belt or for connecting the flexible belt to a second flexible belt, which clip system comprises:

an electrically conductive clip comprising a releaseably engageable buckle, teeth for securing the flexible belt or the second flexible belt within the buckle, and a plug and socket end in operable communication with the teeth by way of an electrical circuit;

a terminal clip comprising at one end a D-ring type buckle and at an opposing end a plug and socket configured for engagement with the plug and socket end of the electrically conductive clip.

13. The safety directional indicator of claim 1, wherein a viewing angle of the LEDs is between 30° and 120°.

14. The safety directional indicator of claim 1 further comprising a lens to focus light emitted from the LEDs into the light transmitting bars so as to minimize loss in flux.

15. The safety directional indicator of claim 1, further comprising a lens disposed between each LED and light transmitting bar to focus light emitted from the LEDs into the light transmitting bars so as to minimize loss in flux, and wherein a viewing angle of the LEDs is between 30° and 120°.

16. The safety directional indicator of claim 1 comprising a light transmitting bar with an internal reflection ranging from 50%-90%.

17. The safety directional indicator of claim 1 comprising a light transmitting bar with a refractive index ranging from 1.4-1.5.

* * * * *